US007895960B2

(12) United States Patent
De Cherance

(10) Patent No.: US 7,895,960 B2
(45) Date of Patent: Mar. 1, 2011

(54) PROCESS FOR THE PRODUCTION OF A FRAME FOR CONSTRUCTION AND FRAME THUS OBTAINED

(76) Inventor: Frédéric De Cherance, Guiche (FR)

( * ) Notice: Subject to any disclaimer, the term of this patent is extended or adjusted under 35 U.S.C. 154(b) by 760 days.

(21) Appl. No.: 11/793,774

(22) PCT Filed: Dec. 20, 2005

(86) PCT No.: PCT/FR2005/051120

§ 371 (c)(1),
(2), (4) Date: Sep. 11, 2007

(87) PCT Pub. No.: WO2006/067358

PCT Pub. Date: Jun. 29, 2006

(65) Prior Publication Data

US 2009/0123230 A1 May 14, 2009

(30) Foreign Application Priority Data

Dec. 21, 2004 (FR) ..... 04 53141

(51) Int. Cl.
*B63B 35/34* (2006.01)
*B63B 35/38* (2006.01)
*B63B 35/44* (2006.01)

(52) U.S. Cl. ..... 114/264; 114/266; 114/267

(58) Field of Classification Search ..... 114/263, 114/264–267; 405/218–221, 26, 27
See application file for complete search history.

(56) References Cited

U.S. PATENT DOCUMENTS

| | | | | | |
|---|---|---|---|---|---|
| 3,490,407 | A | * | 1/1970 | Dempster | 114/264 |
| 3,951,085 | A | * | 4/1976 | Johnson et al. | 114/266 |
| RE31,984 | E | | 9/1985 | Sluys | |
| 4,554,883 | A | * | 11/1985 | Lane | 114/266 |
| 4,715,307 | A | * | 12/1987 | Thompson | 114/65 A |
| 5,050,524 | A | * | 9/1991 | Kyhl et al. | 114/263 |
| 5,199,370 | A | * | 4/1993 | Berquist | 114/263 |
| 5,215,027 | A | * | 6/1993 | Baxter | 114/266 |
| 5,421,282 | A | * | 6/1995 | Morris | 114/264 |
| 5,524,549 | A | * | 6/1996 | Morris | 114/264 |
| 6,138,600 | A | * | 10/2000 | Berquist | 114/267 |
| 6,145,463 | A | * | 11/2000 | Zeilinger | 114/267 |
| 6,199,502 | B1 | | 3/2001 | Mattson | |
| 2004/0261338 | A1 | | 12/2004 | De Cherance | |

FOREIGN PATENT DOCUMENTS

WO 03/031732 A1 4/2003

* cited by examiner

*Primary Examiner*—Ajay Vasudeva
(74) *Attorney, Agent, or Firm*—Young & Thompson

(57) ABSTRACT

A process for the production of a frame for a construction adapted to float includes the steps consisting in: forming a flotation element (12) whose upper portion includes a network of grooves adapted to form formwork for beams (14) of concrete as well as wells, passing through the flotation element (12), adapted to form formwork for concrete columns (16); preferably, arranging reinforcing iron in the formworks and adding at the periphery a formwork to form a belt; and pouring the concrete.

20 Claims, 5 Drawing Sheets

Fig. 10
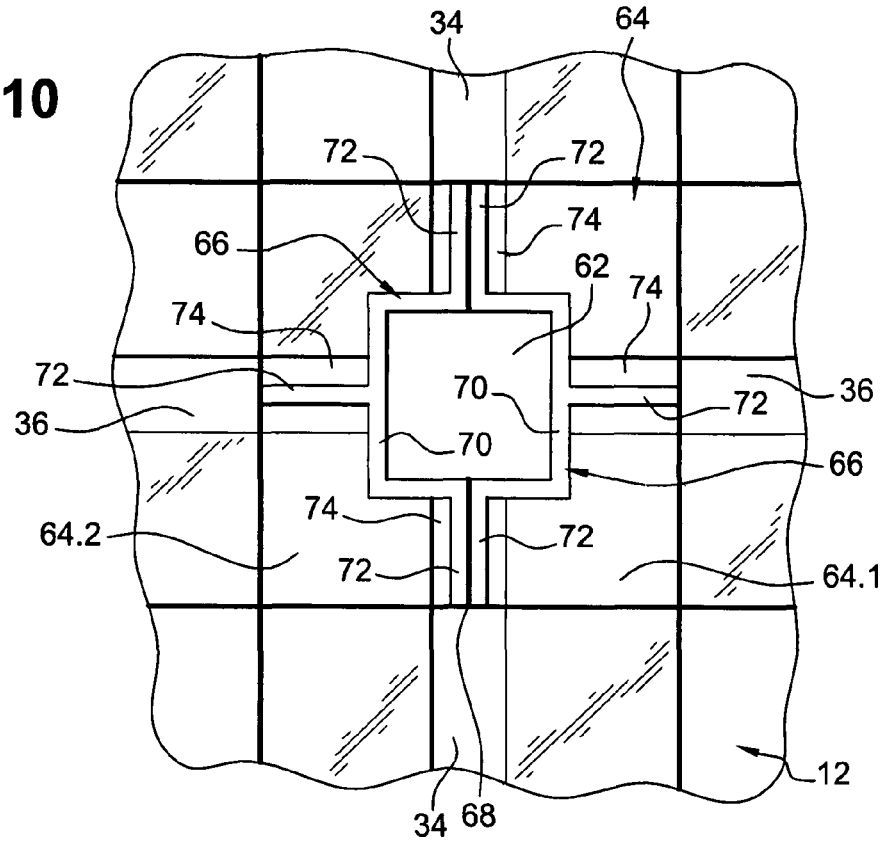
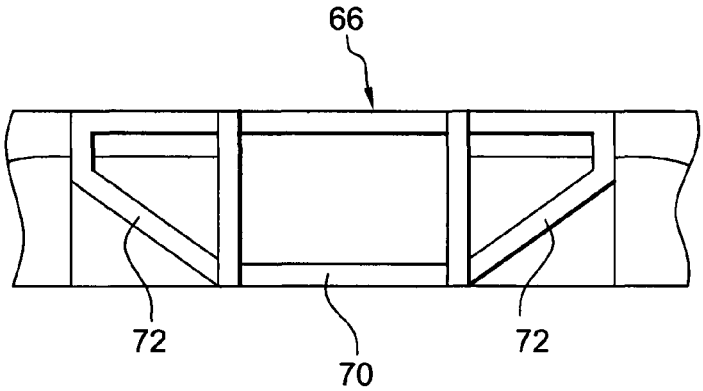
Fig. 11
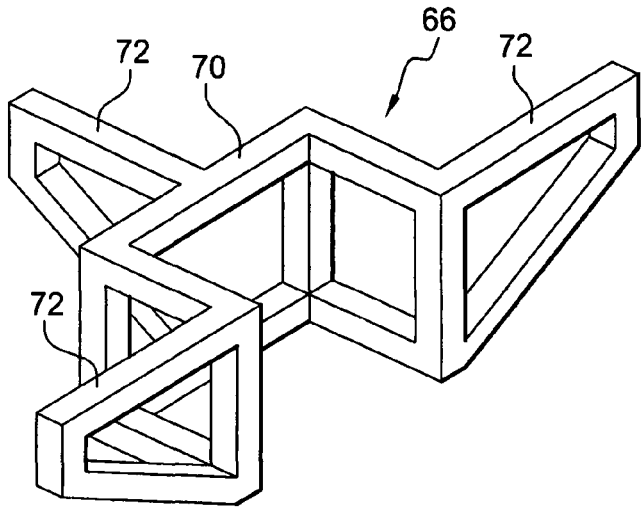
Fig. 12

PROCESS FOR THE PRODUCTION OF A FRAME FOR CONSTRUCTION AND FRAME THUS OBTAINED

CROSS-REFERENCE TO RELATED APPLICATIONS

The present application claims benefit of priority and incorporates by reference PCT/FR2005/051120 filed Dec. 20, 2005 and French Application 04/53141 filed Dec. 21, 2004.

STATEMENT REGARDING FEDERALLY SPONSORED RESEARCH OR DEVELOPMENT

None.

THE NAMES OF THE PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION

1. Field of the Invention

The present invention relates to a process for the production of a frame for construction, particularly for a frame more particularly adapted to a construction adapted to float, such as is described in Patent Application WO 03/31732.

2. Description of Related Art

Patent Application WO 03/31732 proposes a construction adapted to move between a first position bearing on the ground and a second position floating. According to this document, the frame of the construction is constituted of joists of galvanized steel or aluminum for example, forming a network adapted to receive the insulated flooring of a construction. This network is necessary to ensure the distribution of the load and to preserve the plan of the flooring.

The frame also comprises flotation means in the form of caissons trapped in the network of the metallic structure formed by the joists.

Even if this mode of construction provides a suitable basis for construction, it does not give complete satisfaction for the following reasons:

In the first place, the metallic structure must be treated to be able to resist corrosion, particularly if it is used as a frame for a construction as described in Patent Application WO 03/31732. This treatment necessarily leads to an increase of the cost of the structure. Moreover, given the use, this surface treatment has the tendency to deteriorate, rendering necessary periodic maintenance.

In the second place, the production by mechano-welding of the structure leads to a large number of production hours leading to a high cost of the structure. This price is the greater, the greater is the price of steel itself.

Moreover, the insertion of flotation means in the form of caissons within the metallic structure in the form of a network is relatively long and complicated to carry out, leading to an increase in the cost of the frame.

Finally, it is necessary to ensure a resistant mechanical connection between the flotation means and the metallic structure rendering even more complicated and hence more costly the process of production of such a structure.

Also, the present invention seeks to overcome the drawbacks of the prior art by providing a process for the production of a frame for a construction, particularly a frame for a construction adapted to float such as described in Patent Application WO 03/31732, said process being simple to use, permitting reducing the cost of production and obtaining a resistant structure from the mechanical point of view.

BRIEF SUMMARY OF THE INVENTION

To this end, the invention has for its object a process for the production of a frame floor a construction adapted to float, characterized in that it comprises the steps consisting in:

forming flotation means whose upper portion comprises a network of grooves adapted to form a framework for concrete beams as well as wells, passing through said flotation means, adapted to form framework for concrete columns, preferably, arranging pieces of iron in the framework and adding at the periphery of framework to form a belt, and casting the concrete.

The present invention also provides a frame obtained according to the mentioned process as well as a module used to make up said frame.

BRIEF DESCRIPTION OF THE SEVERAL VIEWS OF THE DRAWINGS

Other characteristics and advantages will become apparent from the description which follows, of the invention, which description is given only by way of example, with respect to the accompanying drawings, in which:

FIG. 10 is a top plan showing the modules surrounding the conduit provided with the frame to permit the passage of guide piling, FIG. 11 is a side view showing in detail the half module provided for the passage of the piling provided with an insert forming a reinforcement, and FIG. 12 is a perspective view showing the insert forming a reinforcement.

DETAILED DESCRIPTION OF THE INVENTION

Figure 1:
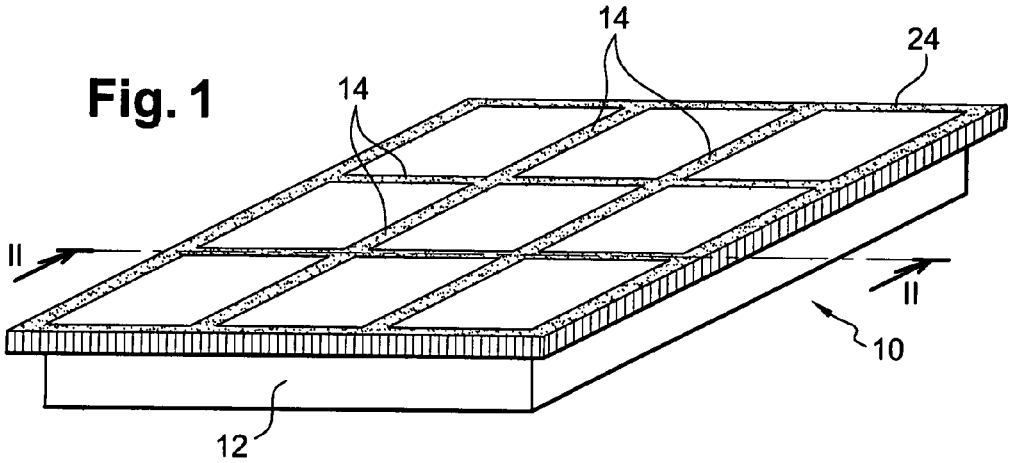
FIG. 1 is a perspective view of a frame according to the invention.

In FIG. 1, there is shown a frame 10 on which can be connected a construction (not shown). This frame 10 is more particularly adapted to move the constructions movable between two positions, a first bearing on the ground and a second floating, such as described in the Patent Application WO 03/31732. However, this frame can be used for other types of constructions requiring a frame forming a foundation outside the ground.

According to the invention, the frame comprises flotation means 12 whose upper portion comprises a network of grooves adapted to form framework for beams 14 of concrete, as well as wells, passing through said flotation means 12, adapted to form formwork for the columns 16 of concrete.

This arrangement permits obtaining a resistant frame thanks to the network of beams 14, adapted to receive a slab or a floor for construction, said frame being adapted to resist the compressive forces produced by the construction thanks to columns 16.

As shown in FIG. 1, the network is constituted by a first series of beams preferably equidistant and a second series of beams, preferably equidistant, perpendicular to the first beams.

The cross section of the beams, the distance separating the beams as well as their number, are determined by one skilled in the art as a function particularly of the load adapted to be applied to the frame 10. Similarly, the cross section of the columns, their number and their emplacement are determined by one skilled in the art such that the frame will resist compressive forces.

Preferably, the columns 16 are disposed at the level of the intersections of the beams 14.

Figure 2A:
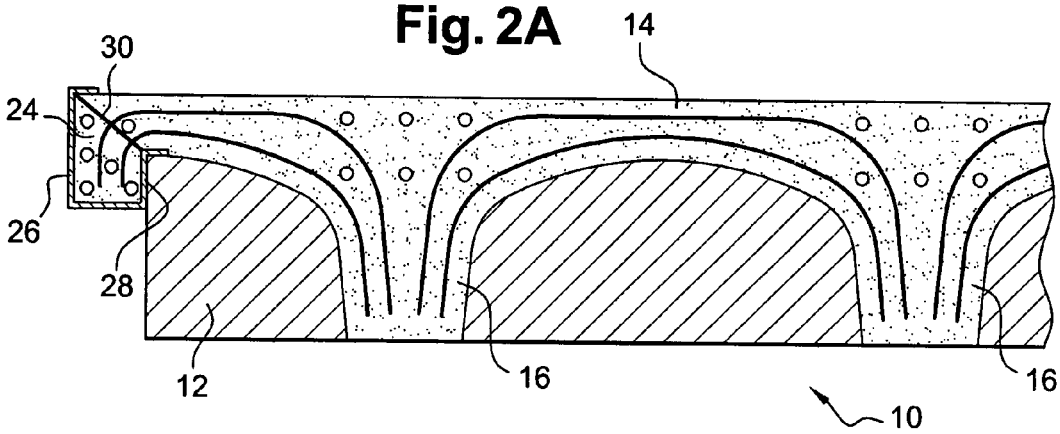
FIG. 2A is a cross section of the frame according to a first modified embodiment.
Figure 2B:
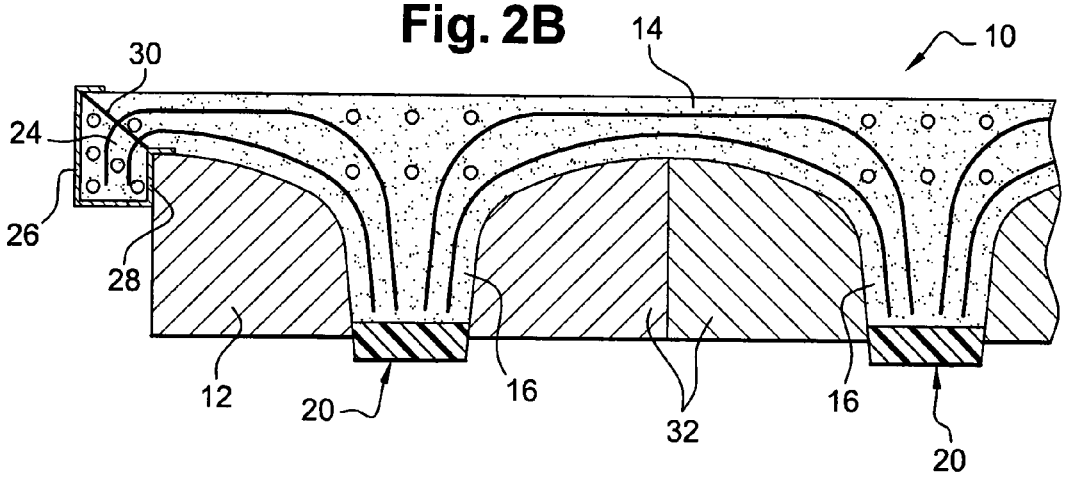
FIG. 2B is a cross section of the frame according to another modification.

According to another characteristic of the invention, the beams 14 interconnect the columns 16, and have a lower surface in the form of an arch, as shown in FIGS. 2A and 2B, thereby to increase the mechanical properties of said beams 14.

Figure 7:
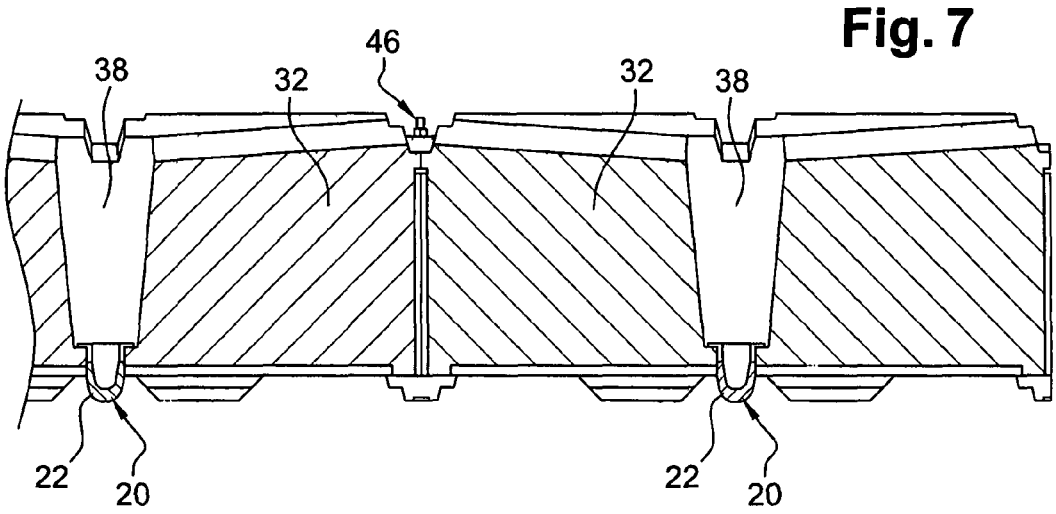
FIG. 7 is a cross sectional view showing two modules assembled according to a first plane in vertical cross section.

Preferably, the feet of the columns 16 comprise shock absorber means 20, projecting from the lower surface of the flotation means 12. According to one embodiment, the shock absorber means are obtained from a rubber insert 22 as shown in FIG. 7, disposed in the lower portion of the wells into which are poured the columns. Each insert 22 comprises an upper portion having a small collar adapted to bear against a shoulder provided in the lower portion of the wells. This arrangement permits increasing the resistance of the frame and of the construction in case of an earthquake, by separating the frame and the construction from the ground. This arrangement permits imparting to the frame anti-earthquake properties.

According to another characteristic of the invention, the frame 10 comprises at the level of its upper portion, at the periphery, a belt 24 of reinforced concrete adapted to form a constriction. According to a preferred embodiment, the frame comprises at its periphery a formwork 26 in the form of a U-shaped gutter of which a first branch 28 is connected to the flotation means 12. Tension members 30 are preferably provided to connect the upper ends of the branches of the U-shaped gutter so as to avoid deformation of said gutter during pouring the concrete. The tension members 30 are distributed all about the belt. According to modified forms, the formwork 26 can be connected directly to the flotation means 12 and/or the tension members 30 can be connected by any suitable means, such as for example by welding, to the ironwork provided for the beams 14.

According to a simplified modification of the invention, the process of production of a frame for construction comprises the following steps consisting in:

forming the flotation means 12 whose upper portion comprises a network of grooves adapted to form framework for beams 14 of concrete, as well as wells, passing through said flotation means 12, adapted to form formwork for the concrete columns 16, preferably, arranging ironwork in the framework and adding at the periphery of framework to form a belt, and pouring the concrete.

After the concrete sets up, the formwork used to cast the concrete forms the flotation means. Thanks to the network of beams connected to the wells, there is obtained a mechanical connection between the concrete portion and the flotation means. This connection can be reinforced by any means, such as for example by increasing the roughness of the surface of the flotation means forming a formwork.

According to a first modification, the frame 10 comprises only a network of beams in the upper portion as shown in FIG. 1. According to another modification, the frame 10 is covered with a concrete slab comprising in its lower portion the beams 14 of the columns 16.

According to a preferred modification, the flotation means 12 are made by assembly of several modules 32 as shown in FIGS. 2B, 3-9, said modules being made by molding plastic material. According to a simplified modification, the flotation means can be made of a single component as shown in FIG. 2A.

According to one embodiment, the module 32 of substantially parallelpipedal form is made by rotomolding.

The height of the modules 32 is adjusted as a function of the load supported by the frame such that this latter can particularly float. As a modification, there can be stacked layers of modules 32 so as to increase the flotation capacities of the frame. To this end, the upper surface of the module has a shape adapted to coact with the lower surface of the upper module.

Each module 32 comprises at the level of its upper surface two grooves 34 and 36, adapted to form a formwork for the beams 14, said grooves 34 and 36 being preferably substantially perpendicular and in a median position when the module has a square or rectangular shape.

As a supplement, the module comprises a well 38 adapted to form a formwork for a column 16. Preferably, the well 38 is disposed at the intersection of the grooves 34 and 36.

Preferably, the bottom of the grooves 34 and 36 is incurved and inclined toward the well 38 so as to form arches when the modules are assembled, as shown in FIG. 2B.

Figure 4:
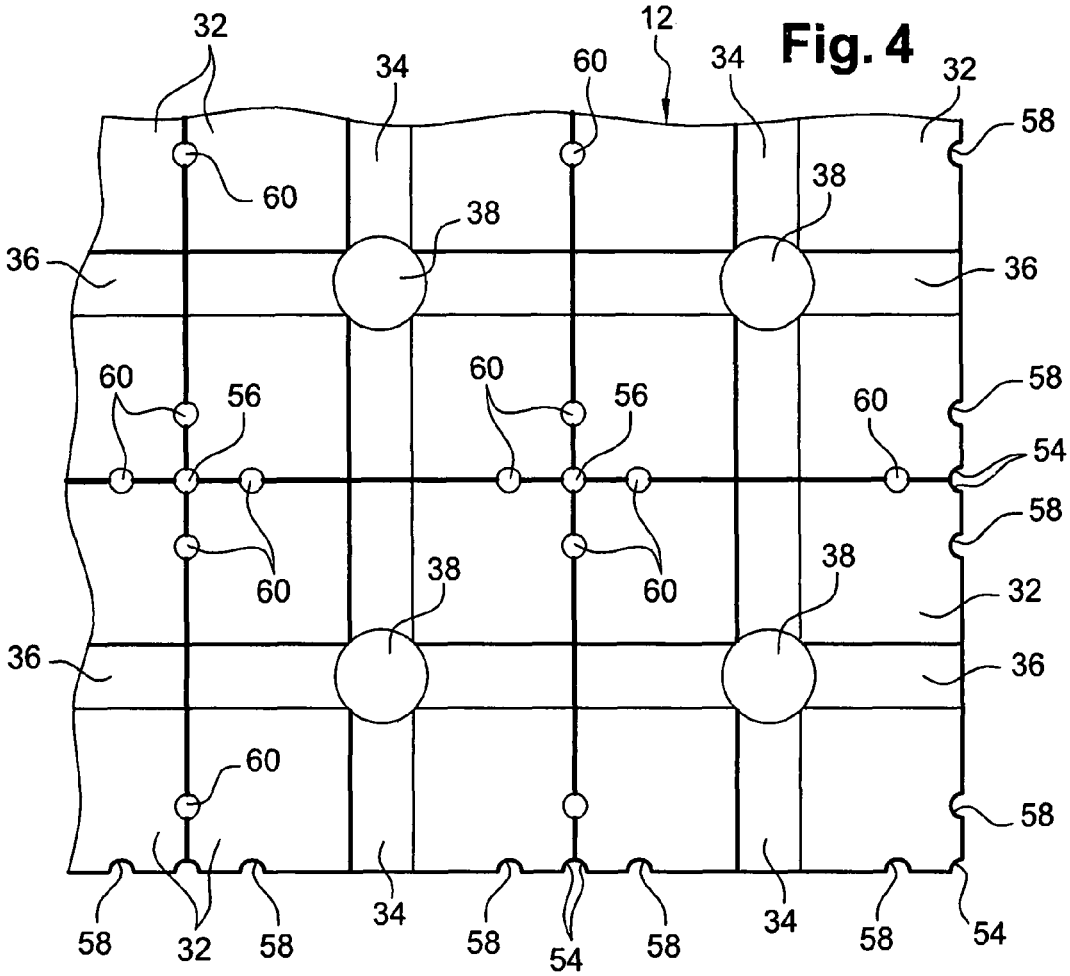
FIG. 4 is a top plan view of modules assembled to form a frame.

According to a modification, the process for production consists in assembling modules 32 so as to form flotation means 12 with an upper portion of a network of grooves adapted to form formworks for the concrete beams 14 as well as for the wells, passing through said flotation means 12, adapted to form formwork for the columns 16 of concrete, as shown in FIG. 4.

When the modules are assembled, the concrete can then be cast, after having preferably added reinforcing iron in the formwork as well as if desired the formwork forming the peripheral belt.

Figure 3:
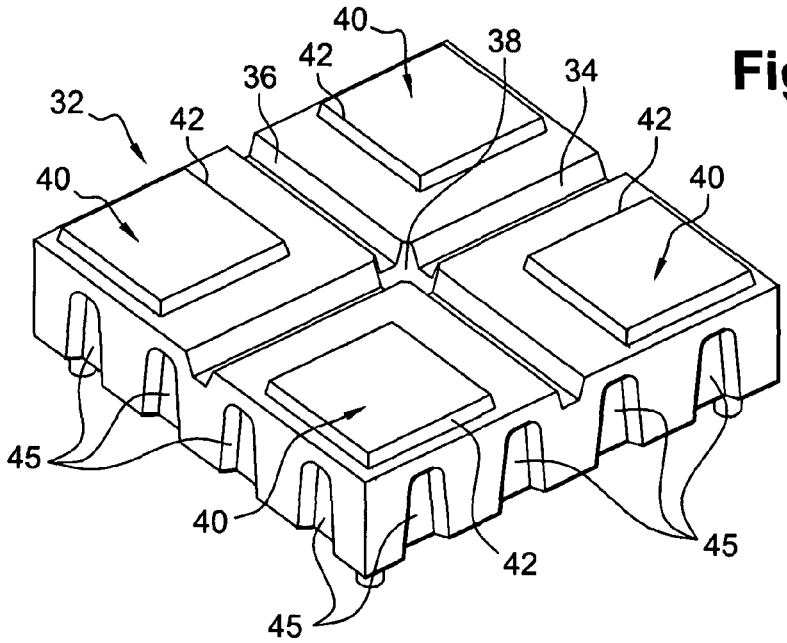
FIG. 3 is a perspective view of a module used to form a frame.
Figure 5:
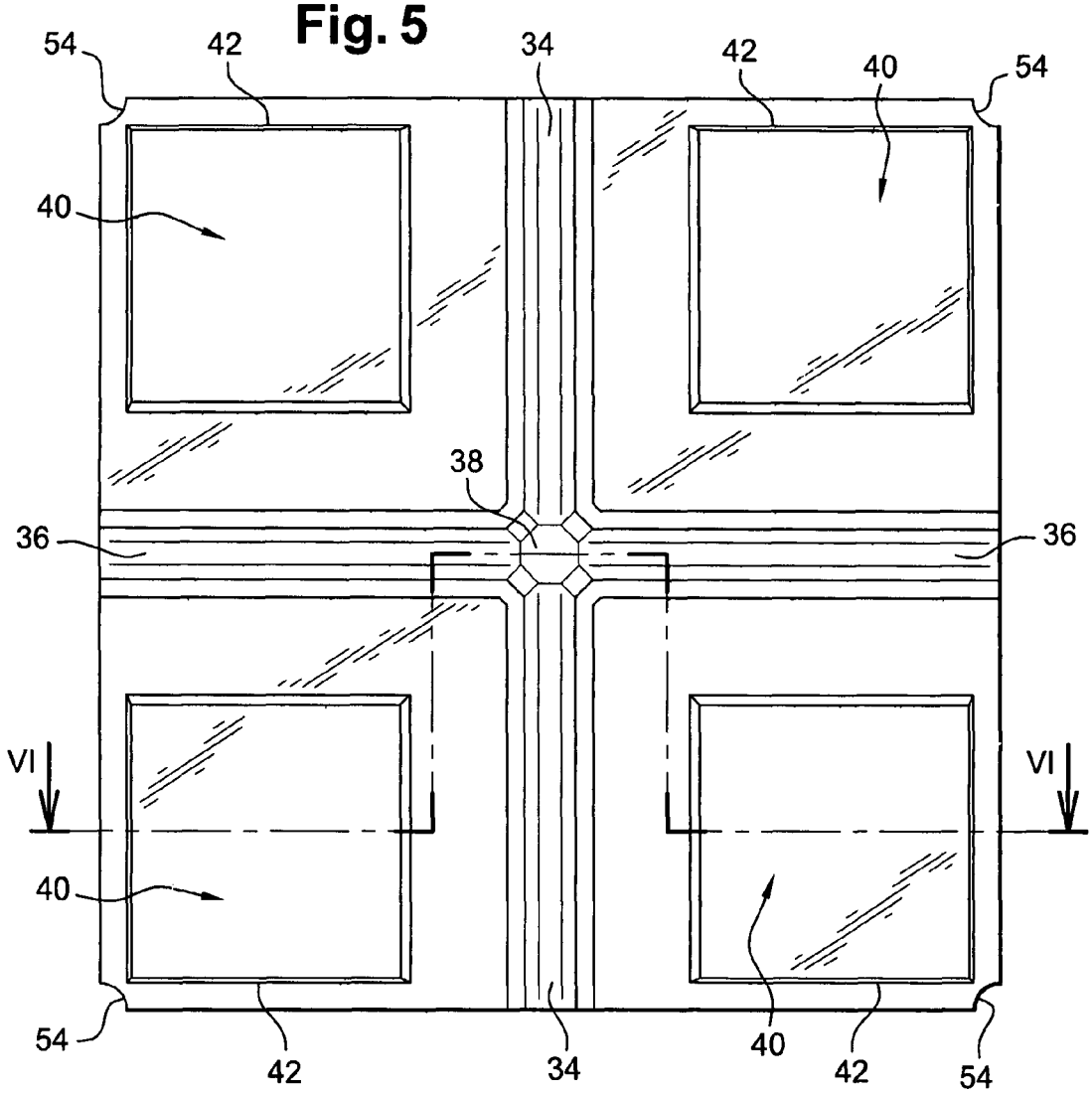
FIG. 5 is a top plan view of the module shown in FIG. 3.

As shown in FIGS. 3 and 5, the throats 34 and 36 define in the upper part of the module four sectors 40 each with projecting portions 42 adapted to coact with hollow shapes provided below the lower surface of an upper module. Preferably, for increased productivity, all the modules are identical no matter what the layer. Thus, a same module comprises an upper surface with projecting elements 42 and a lower surface with hollow shapes whose forms are adapted to those of the projecting elements 42.

Figure 6:
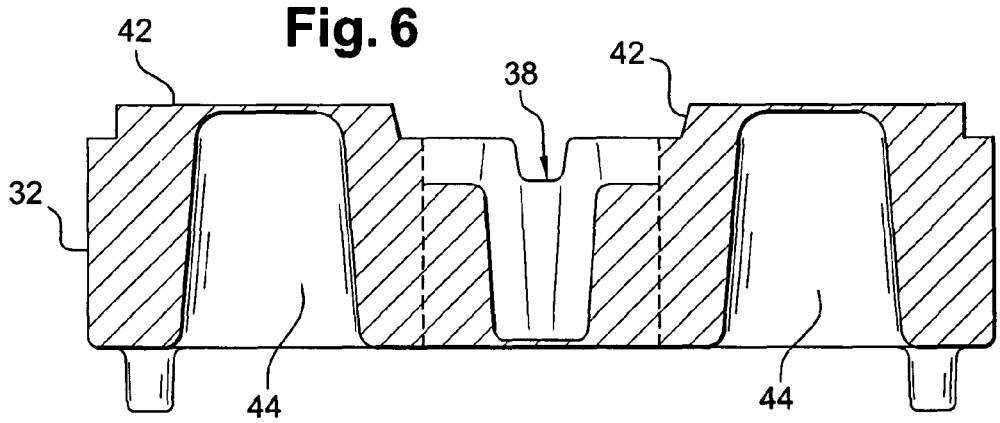
FIG. 6 is a cross section of the line VI-VI of FIG. 5.

According to another characteristic, as shown in FIG. 6, each module comprises in its upper portion at least one recess 44, preferably four at the level of each sector 40. These recesses 44 increase the resistance to compression of the module.

Preferably, the lateral walls of the module also comprise recesses 45 also permitting reinforcing the resistance to compression of the module.

Figure 8:
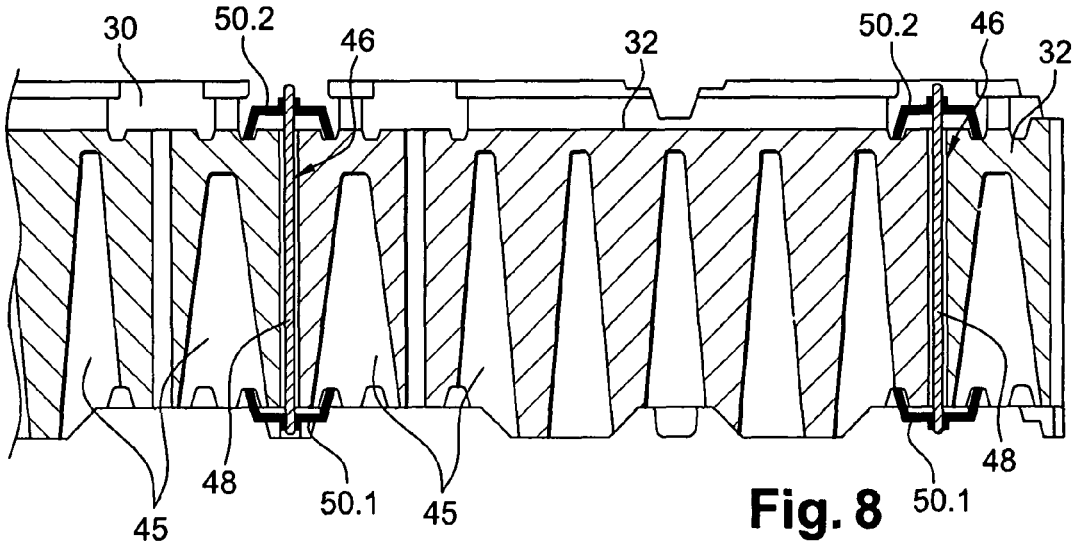
FIG. 8 is a view showing the assembled modules.

According to another characteristic of the invention, the frame comprises assembly means 46 permitting connecting the different modules 32 preliminarily to the casting of the concrete and during hardening. These assembly means 46 comprises a rod 48 with at each end a hook 50. The length of the rod is such that a first hook 50.1 will be disposed below the modules and a second hook 50.2 will be disposed above the modules, as shown in FIG. 8. As a supplement, at least one nut is provided to coact with a screw thread provided on the rods so as to press the hooks 50 against the modules and to lock said modules so as to hold them assembled before casting the concrete. Preferably, as shown in FIGS. 8 and 9, the hooks 50 have curved ends 52 adapted if desired to coact with hollow shapes provided at the level of the modules so as better to grip said modules.

Figure 9:
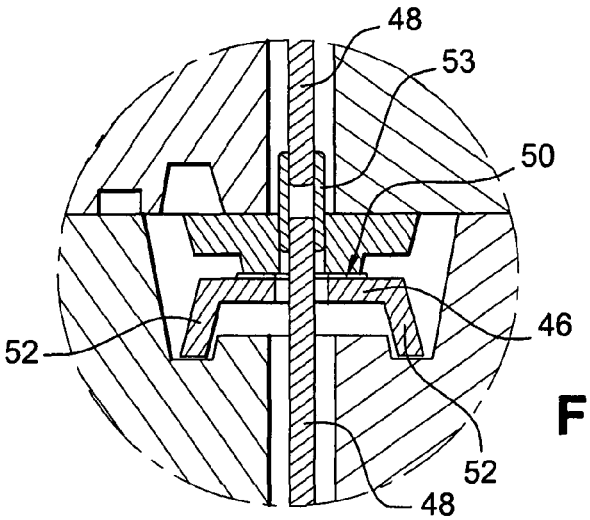
FIG. 9 is a view showing in detail the assembly means.

According to modifications, when the frame comprises several layers of modules, the rods 48 extend over all the height of the frame or connection means 53 are provided to connect the rods of the different levels, as shown in FIG. 9.

Preferably, the rods 48 are disposed at the level of the region of connection of four adjacent modules. To this end, the modules comprise at the level of each angle, a quarter circle cutout 54 extending over all the height of the sidewalls, as shown in FIG. 5. When four modules are assembled, the four adjacent quarter round cutouts 54 form a conduit 56 adapted to receive a rod 48, as shown in FIG. 4. According to another embodiment, in addition to the quarter round cutouts 54, each module comprises at the level of each sidewall, two half round cutouts 58 offset relative to the summit, extending over all the height of the lateral walls, as shown in FIG. 4. When two modules are assembled, the half round cutouts 58 form a conduit adapted to receive a rod 48. These cutouts 58 facilitate assembly of the modules disposed at the periphery.

The process for production of a frame is easy and greatly simplified. It suffices to assemble a suitable number of modules 32 as a function of the surface and the desired shapes of the frame. To hold them assembled, the rods 48 and the hooks 50 are emplaced. If necessary, a second layer or even several layers of modules are thus assembled.

Thus, as before, there is obtained at the level of the upper layer a network of grooves adapted to form formwork for concrete beams 14 as well as wells, passing through said flotation means 12, adapted to form formwork for the concrete columns 16, as shown in FIG. 4. The modules being all identical and being disposed on each other, the wells of each layer coact, permitting obtaining frameworks for columns 16 extending over all the height of the frame.

When the modules are assembled, the concrete can then be poured, after having preferably added reinforcing iron into the formwork as well as if desired the formwork forming the peripheral belt.

According to the process of the invention, there is obtained in an economical manner a frame adapted to support a construction.

Thus, the modules can be made in an industrial manner, which leads to lowering the cost of production. These modules can be then assembled in situ in a rapid manner. Different sizes and shapes of forms can be obtained by assembling identical modules according to the invention. As a function of the load to be supported, the characteristics of the frame can be increased by assembling one or several layers of modules.

Thereafter, it suffices to pour the concrete. After hardening, the frame is directly obtained.

As indicated above, the frame obtained by the invention permits obtaining a floating frame adapted to support a construction so as to obtain a floating construction. However, the present frame could be used in other applications, particularly when it is desired to obtain a foundation out of the ground, disconnected from the ground, such as for example for an earthquake proof construction.

Preferably, the frame is adapted for construction as described in the Patent Application WO 03/31732.

In this case, the frame comprises at least one conduit passing through the frame along its height, to permit the passage of a pile along which the frame can slide when the water level rises and the frame 12 floats.

Preferably, the frame comprises several conduits 62 adapted to receive piles along which the frame 12 can slide.

According to one embodiment, each conduit 62 is provided in a module 64. Preferably, this module 64 comprises reinforcing means 67, preferably metallic, delimiting the conduit 62, adapted to reinforce the module and to limit the deformation of said conduit 62. Preferably, the reinforcing means 66 are connected to the network of beams 14. Thus, they can be embedded at least in part in the network concrete beams or connected to the reinforcing iron used for the network of beams 14.

According to a preferred embodiment and illustrated in FIG. 10, the module or modules 64 are each obtained from two half modules 64.1 and 64.2 that are symmetrical about a vertical median plane 68. In this case, the reinforcing means 66 are in two parts, one part for each half module 64.1 and 64.2. According to one embodiment, the half modules are made by molding, the reinforcing means 66 forming inserts integrated into the mold and partially embedded in the molded material.

The reinforcing means 66 comprise for each half module a cradle 70 with a cross section in a vertical plane of U shape, said cradle 70 being obtained by the assembly and welding of profiles. Thus, each cradle comprises two U shapes, one disposed at the level of the upper plane of the module and the other disposed at the level of the lower plane of the module, crosspieces connecting the U's at the level at the ends of the arms of the U and on opposite sides of the base of the U, as shown in FIGS. 11 and 12.

When the half modules are disposed one against the other, cradles 70 are disposed facing and form a conduit 62 as shown in FIG. 10.

To improve the mechanical characteristic, the reinforcing means 66 comprise for each half module a U-shaped cradle and legs 72 and the half modules comprise throats 74 in prolongation of the throats of the adjacent modules, said legs being disposed at the level of said throats 74. This arrangement permits connecting the reinforcing means 66 to the network of beams 14. According to one embodiment, preferred and shown in FIGS. 10 and 12, a first leg 72 is provided extending perpendicularly to the base of the U of the cradle 70 in a substantially vertical plane, the other legs 72 extending perpendicularly to the branches of the U from their ends in a vertical plane.

As before, the half modules are preferably made by rotomolding.

They are assembled in situ to the other modules 32, thanks to the assembly means 46. Once assembled, the modules form flotation means 12 with, at the level of the upper surface, a network of throats adapted to form formwork for the concrete beams 14 as well as the wells, passing through said flotation means 12, adapted to form formwork for the concrete columns 16.

When the modules are assembled, the concrete can then be poured, after having preferably added reinforcing iron in the formwork as well as if desired the formwork forming the peripheral belt.

According to this embodiment, a portion of the legs 72 is embedded in the network of beams 14, which contributes to the improvement of the mechanical properties of the obtained frame.

Of course, the invention is clearly not limited to the embodiment shown and described above, but on the contrary covers all the modifications particularly as to the dimensions and the materials of the different elements forming the frame. Finally, other materials could be used in the place of concrete to be cast in the grooves and the wells and to ensure mechanical resistance of the frame.

The invention claimed is:

1. A process for the production of a frame for a construction adapted to float, comprising:

forming flotation means (12) whose upper portion comprises a network of grooves adapted to form formwork for concrete beams (14) as well as wells, passing through said flotation means (12), adapted to form formwork for concrete columns (16);

arranging reinforcing iron in the formwork and adding at the periphery a formwork to form a belt; and pouring the concrete.

2. The process for production of a frame according to claim 1, further comprising:

assembling modules (32) so as to form said flotation means (12) with an upper portion of the network of grooves adapted to form formwork for the concrete beams (14) as well as the wells, passing through said flotation means (12), adapted to form formwork for the concrete columns (16);

arranging reinforcing iron in the formwork and adding at the periphery a formwork to form a belt; and performing the pouring the concrete.

3. The process for production of a frame for a construction adapted to float obtained from the process according to claim 2, forming via said flotation means (12) the formwork for the concrete columns (16) as well as the network of the concrete beams (14).

4. The process for production of a frame for a construction adapted to float obtained from the process according to claim 1, further comprising:

forming via said flotation means (12) the formwork for the concrete columns (16) as well as the network of the concrete beams (14).

5. The process for production of a frame for a construction according to claim 4, wherein the network is constituted by a first series of beams (14) and a second series of beams (14), perpendicular to the first beams and in that the columns (16) are disposed at the level of the intersections of the beams (14).

6. The process for production of a frame for a construction according to claim 5, wherein the beams (14) connect the columns (16) to each other, and have a lower surface in the form of an arch.

7. The process for production of a frame for a construction according to claim 6, wherein the feet of the columns (16) comprise shock absorbing means (20), projecting relative to the lower surface of the flotation means (12).

8. The process for production of a frame for a construction according to claim 5, wherein the feet of the columns (16) comprise shock absorbing means (20), projecting relative to the lower surface of the flotation means (12).

9. The process for production of a frame for a construction according to claim 5, wherein the flotation means (12) are made by assembly of several modules (32).

10. The process for production of a frame for a construction according to claim 4, wherein the feet of the columns (16) comprise shock absorbing means (20), projecting relative to the lower surface of the flotation means (12).

11. The process for production of a frame for a construction according to claim 4, further comprising:

assembling several modules (32) to form the flotation means.

12. The process for production of a frame for a construction according to claim 11, further comprising:

holding the modules (32) assembled via assembly means (46).

13. The process for production of a frame for a construction according to claim 12, wherein the frame comprises at least one conduit (62) passing through the frame along its height, to permit the passage of a pile along which the frame slides.

14. The process for production of a frame for a construction according to claim 13, wherein each conduit (62) is provided in a module (64) comprising reinforcing means (66) metallic, delimiting the conduit (62), said reinforcing means (66) being connected to the network of beams (14).

15. The process for production of a frame for construction according to claim 14, wherein the module or modules (64) comprising a conduit (62) are each obtained from two half modules (64.1, 64.2) symmetrical about a vertical medial plane (68), the reinforcing means (66) are made in two parts, one part for each half module (64.1, 64.2) the reinforcing means (66) forming inserts.

16. The process for production of a frame according to claim 4, wherein each module (32) comprises at the level of its upper surface on the one hand two grooves (34, 36) of the network of grooves adapted to form a formwork for the beams (14), said two grooves (34, 36) being substantially perpendicular and in a median position when the module has a square or rectangular shape, and on the other hand the well (38) adapted to form a formwork for the column (16), disposed at the intersection of said two grooves (34, 36).

17. The process for production of for a frame according to claim 16, further comprising:

adapting an upper surface of the module with shapes to coact with the shapes of the lower surface.

18. The process for production of for a frame according to claim 16, wherein the module comprises at least one recess (44), opening at the level of the lower surface to reinforce the resistance to compression of the module.

19. The process for production of for a frame according to claim 16, wherein the sidewalls of the module comprise recesses (45) to reinforce the resistance to compression of the module.

20. The process for production of for a frame according to claim 16, wherein the module comprises cutouts (54, 56) at the level of the sidewalls of the module, extending over all the height of the module, to permit the passage of assembly means.

* * * * *